US009266331B2

(12) United States Patent
Sakuma et al.

(10) Patent No.: US 9,266,331 B2
(45) Date of Patent: Feb. 23, 2016

(54) MANUFACTURING METHOD OF SUBSTRATE FOR LIQUID EJECTION HEAD

(71) Applicant: CANON KABUSHIKI KAISHA, Tokyo (JP)

(72) Inventors: Sadayoshi Sakuma, Yokohama (JP); Hirokazu Komuro, Yokohama (JP); Yuzuru Ishida, Yokohama (JP); Kazuaki Shibata, Oita (JP); Makoto Sakurai, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 357 days.

(21) Appl. No.: 13/926,651

(22) Filed: Jun. 25, 2013

(65) Prior Publication Data

US 2014/0013600 A1 Jan. 16, 2014

(30) Foreign Application Priority Data

Jul. 10, 2012 (JP) ..... 2012-154598

(51) Int. Cl.
*B21D 53/76* (2006.01)
*B41J 2/16* (2006.01)
*B41J 2/14* (2006.01)

(52) U.S. Cl.
CPC ..... *B41J 2/1637* (2013.01); *B41J 2/14129* (2013.01); *B41J 2/1603* (2013.01); *B41J 2/1628* (2013.01); *B41J 2/1629* (2013.01); *B41J 2/1631* (2013.01); *B41J 2/1632* (2013.01); *B41J 2/1635* (2013.01); *B41J 2/1639* (2013.01); *B41J 2/1642* (2013.01); *B41J 2/1643* (2013.01); *B41J 2/1645* (2013.01); *B41J 2/1646* (2013.01); *Y10T 29/49002* (2015.01); *Y10T 29/49401* (2015.01)

(58) Field of Classification Search
CPC .... B41J 2/1637; B41J 2/14129; B41J 2/1603; B41J 2/1628; B41J 2/1629; B41J 2/1631; B41J 2/1632; B41J 2/1635; B41J 2/1639; B41J 2/1642; B41J 2/1643; B41J 2/1645; B41J 2/1646; Y10T 29/49401; Y10T 29/49002; Y10T 29/49; Y10T 29/49128; Y10T 29/49165
USPC ..... 29/890.1, 592, 611, 629, 831, 832, 852; 347/65, 63, 61, 20; 438/745
See application file for complete search history.

(56) References Cited

U.S. PATENT DOCUMENTS 6,145,965 A 11/2000 Inada et al.
2012/0047738 A1* 3/2012 Koyama ..... B41J 2/1604 29/890.1

FOREIGN PATENT DOCUMENTS

JP 9-001809 A 1/1997
JP 2009-178906 A 8/2009

*Primary Examiner* — Peter DungBa Vo
*Assistant Examiner* — Azm Parvez
(74) *Attorney, Agent, or Firm* — Fitzpatrick, Cella, Harper & Scinto

(57) ABSTRACT

Provided is a method for manufacturing a substrate for liquid ejection head including an ejection energy generating element and a nozzle layer including an ejection port and a liquid channel. The method includes the steps of: forming, on the substrate including the element, a metal mold member made of metal and having a flat surface, the metal mold member making up at least a part of a mold for the liquid channel, and a planarization layer made of the metal and having a flat surface to planarize a surface of the nozzle layer; coating the mold for the liquid channel and the planarization layer with negative-type photosensitive resin, thus forming a negative-type photosensitive resin layer to be the nozzle layer; exposing the resin layer to ultraviolet rays, thus forming the ejection port; and selectively removing the mold for the liquid channel, thus forming the liquid channel.

15 Claims, 5 Drawing Sheets

MANUFACTURING METHOD OF SUBSTRATE FOR LIQUID EJECTION HEAD

BACKGROUND OF THE INVENTION

1. Field of the Invention

The present invention relates to a manufacturing method of a substrate for liquid ejection head such as a substrate for ink jet recording head configured to implement recording by ejection of ink.

2. Description of the Related Art

Liquid ejection heads are used for a wide range of purposes such as printers, manufacturing apparatuses of display components and medical inhalers, and the application thereof to a lot of industries are expected in the future. Especially for a liquid ejection head for printers, an ink jet recording head is available, which can eject liquid droplets densely and precisely.

A substrate for such an ink jet recording head is conventionally manufactured by a semiconductor manufacturing technique using a substrate made of silicon. Specifically, the manufacturing begins with the formation, on a silicon substrate, of an ejection energy generating element including a heat generating resistant element and the like configured to generate bubbles of ink for ejection and a driving circuit to drive the heat generating resistant element by methods such as photolithography, vacuum film formation and etching. Then, an ink channel mold member to be a mold for an ink channel is formed on this substrate by photolithography, on which photosensitive resin is applied by spin coating for film formation. The thus obtained photosensitive resin layer is then exposed to ultraviolet rays, for example, to form an ink ejection port, and the ink channel mold member is removed, thus forming a nozzle layer (nozzle plate) made of this photosensitive resin and thus manufacturing a substrate for ink jet recording head.

Unfortunately, due to a difference in thickness of an underlayer under (on the substrate side) this photosensitive resin layer, e.g., due to a difference in thickness at a part of the ejection energy generating element on the substrate, the photosensitive resin to be the nozzle layer applied by spin coating on the ink channel mold member may have a non-uniform film thickness. The film thickness of the photosensitive resin layer directly relates to the thickness of an ink ejection port (orifice), and so is an important factor affecting the ejection performance.

As another problem caused by a difference in thickness of the underlayer such as at the ejection energy generating element, reflected light of the ultraviolet ray exposed to the photosensitive resin layer, which occurs due to such a difference in thickness, deforms a shape of the ejection port unlike a desired shape, thus adversely affecting the ink ejection performance of the ink jet recording head.

To avoid this, Japanese Patent Application Laid-Open No. H09-001809 (1997) proposes a method including an ink channel mold member formation step of disposing a dummy pattern made of the same material as that of the ink channel mold member at a region other than the ink channel as well, thus making the thicknesses of the ink channel mold member and a nozzle layer to be formed on this dummy pattern uniform. Japanese Patent Application Laid-Open No. 2009-178906 proposes a method of forming an anti-reflection film on a substrate having an ejection energy generating element thereon, whereby an ejection port is formed while suppressing reflection from the underlayer, and then removing this anti-reflection film.

SUMMARY OF THE INVENTION

A method for manufacturing a substrate for liquid ejection head of the present invention is to manufacture a substrate including an ejection energy generating element to generate energy to eject liquid, and a nozzle layer including an ejection port to eject liquid and a liquid channel communicating with the ejection port, the liquid channel being configured to dispose liquid on the ejection energy generating element. The method includes the steps of: (1) forming, on the substrate including the ejection energy generating element, a metal mold member made of metal and having a flat surface, the metal mold member making up at least a part of a mold for the liquid channel, and a planarization layer made of the metal and having a flat surface, the planarization layer being configured to planarize a surface of the nozzle layer; (2) coating the mold for the liquid channel and the planarization layer with negative-type photosensitive resin, thus forming a negative-type photosensitive resin layer to be the nozzle layer; (3) exposing the negative-type photosensitive resin layer to ultraviolet rays, thus forming the ejection port; and (4) selectively removing the mold for the liquid channel, thus forming the liquid channel.

Further features of the present invention will become apparent from the following description of exemplary embodiments with reference to the attached drawings.

DESCRIPTION OF THE EMBODIMENTS

These methods described in Japanese Patent Application Laid-Open No. H09-001809 (1997) and Japanese Patent Application Laid-Open No. 2009-178906 each can solve one of the problems of deformation of the ink ejection port due to a difference in thickness of the underlayer under the nozzle layer and of non-uniform film thickness of the nozzle layer, but cannot solve both of them at the same time.

In view of this, it is an object of the present invention to provide a manufacturing method of a substrate for liquid ejection head capable of making the thickness of a nozzle layer (especially at a part of an ejection port) uniform, while shaping the ejection port precisely.

Preferred embodiments of the present invention will now be described in detail in accordance with the accompanying drawings.

<Substrate for Liquid Ejection Head>

A substrate for liquid ejection head according to the present invention can be used for liquid ejection heads that can be mounted at devices such as printers, copying machines, facsimiles and word processors equipped with a printer as well as industrial recording devices including the complex combination of various processing devices. Specifically, this substrate for liquid ejection head may be used in an ink jet recording head configured to perform recording by ejecting ink to a recording medium and in a liquid ejection head for the use of biochip production and electronic circuit printing. An ink jet recording head equipped with this substrate for liquid ejection head enables recording on various recoding media including not only paper but also thread, fiber, cloth, leather, metal, plastic, glass, wood, ceramics and the like.

The following describes the usage as an ink jet recording head among theses usages of a liquid ejection head, and the present invention is not limited to this.

Figure 1A:
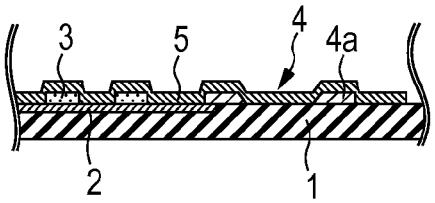
FIGS. 1A, 1B, 1C, 1D, 1E, 1F, 1G, 1H, 1I, 1J and 1K are schematic cross-sectional views to describe the steps of one embodiment of the present invention.
Figure 1B:
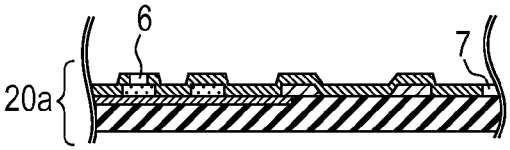
Figure 1C:
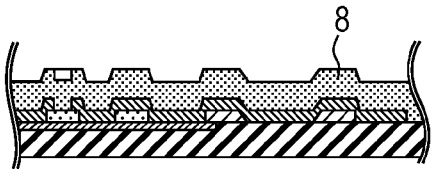
Figure 1D:
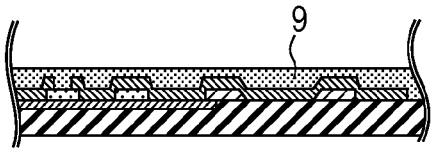
Figure 1E:
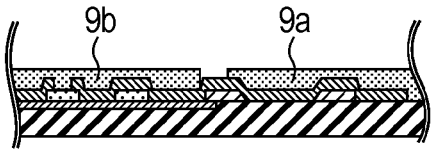
Figure 1F:
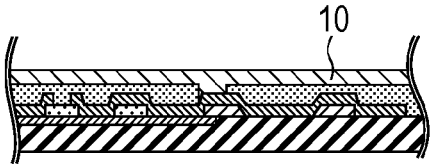
Figure 1G:
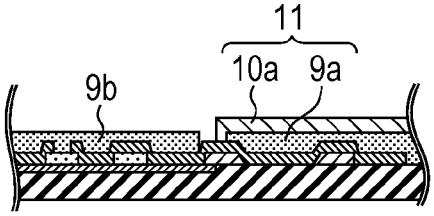
Figure 1H:
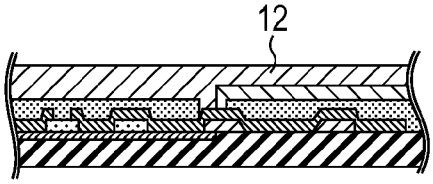
Figure 1I:
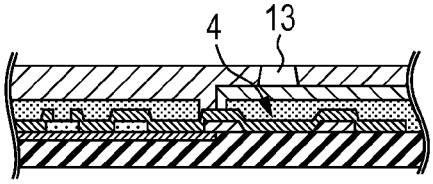
Figure 1J:
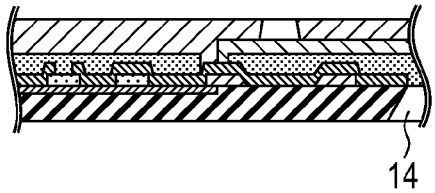
Figure 1K:
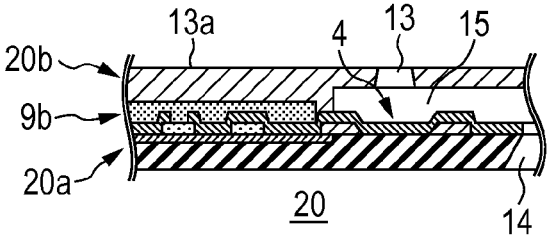
Figure 2:
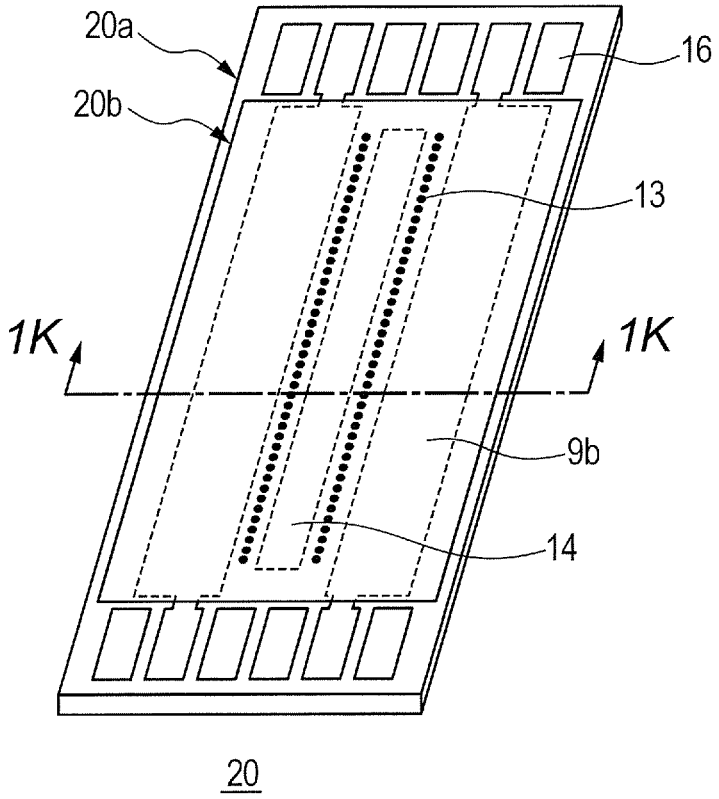
FIG. 2 is a perspective view of an exemplary substrate for liquid ejection head according to the present invention.

Firstly, FIG. 2 is a perspective view showing the appearance of a substrate for liquid ejection head according to the present invention. FIGS. 1A to 1K, FIGS. 4A to 4C and FIGS. 5A to E are schematic cross-sectional views to describe the steps of the manufacturing method of the present invention according to some embodiments. These drawings show the manufacturing steps one by one, showing a partially schematic cross section taken along the line 1K-1K of a substrate for liquid ejection head 20 in FIG. 2. Herein since the cross section taken along the line 1K-1K has a substantially symmetrical structure about a liquid supply port 14, these drawings show a part of the region on one side only.

As shown in FIGS. 1A to 1K and FIG. 2, the substrate for liquid ejection head 20 according to the present invention includes: a substrate 20*a* (this may be called an ejection element substrate) including an ejection energy generating element; and a nozzle layer 20*b* having an ejection port (e.g., an ink ejection port) 13 and a liquid channel (e.g., an ink channel) 15. This substrate for liquid ejection head 20 is provided with a planarization layer 9*b* made of metal to planarize the surface of the nozzle layer 20*b* (face having the ejection port 13 (ejection port face) 13*a*) between the ejection element substrate 20*a* and the nozzle layer 20*b*. The substrate for liquid ejection head 20 further may be provided with an electrode pad 16 made of the same metal as the planarization layer, for example, on the ejection element substrate 20*a*.

More specifically, as shown in FIGS. 1A to 1K, FIGS. 4A to 4C and FIGS. 5A to 5E, this ejection element substrate 20*a* is configured so that an ejection energy generating element 4 generating energy to eject liquid (e.g., ink) is disposed on a substrate 1 made of monocrystalline silicon, for example. This ejection element substrate 20*a* may be further provided with a driving circuit 2 configured to selectively drive this ejection energy generating element 4, a metal wiring layer 3 for electrical connection of them for operation, an insulation protection layer 5, a diffusion barrier layer 17 and a plating seed layer 18. The ejection element substrate 20*a* may be still further provided with a liquid supply port (e.g., ink supply port) 14 to supply liquid to the liquid channel 15, the liquid supply port 14 communicating with this liquid channel. FIG. 2 shows the state where this liquid supply port 14 is formed at a central part of the ejection element substrate 20*a* so as to penetrate from the surface (the face on which the nozzle layer 20*b* is formed) of the substrate 20*a* to the rear face.

As stated above, this nozzle layer 20*b* disposed on the surface of the ejection element substrate 20*a* is provided with the ejection port 13 to eject liquid and the liquid channel 15 communicating with this ejection port and to dispose (hold) liquid on the ejection energy generating element 4. This ejection port 13 may be disposed so as to correspond to the position of the ejection energy generating element 4, and in FIGS. 1A to 1K, the ejection port 13 is formed above the ejection energy generating element 4 (above in the sheet).

Figure 3A:
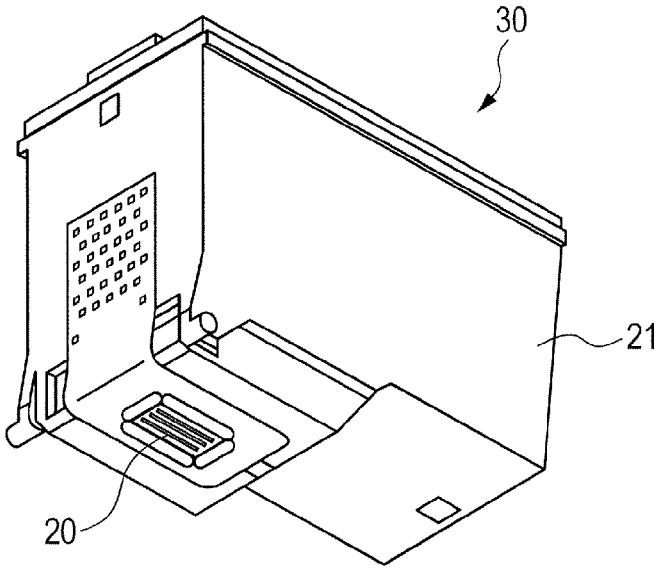
FIG. 3A is a perspective view of an ink jet recording head, to which a substrate for liquid ejection head according to the present invention is applicable.
Figure 3B:
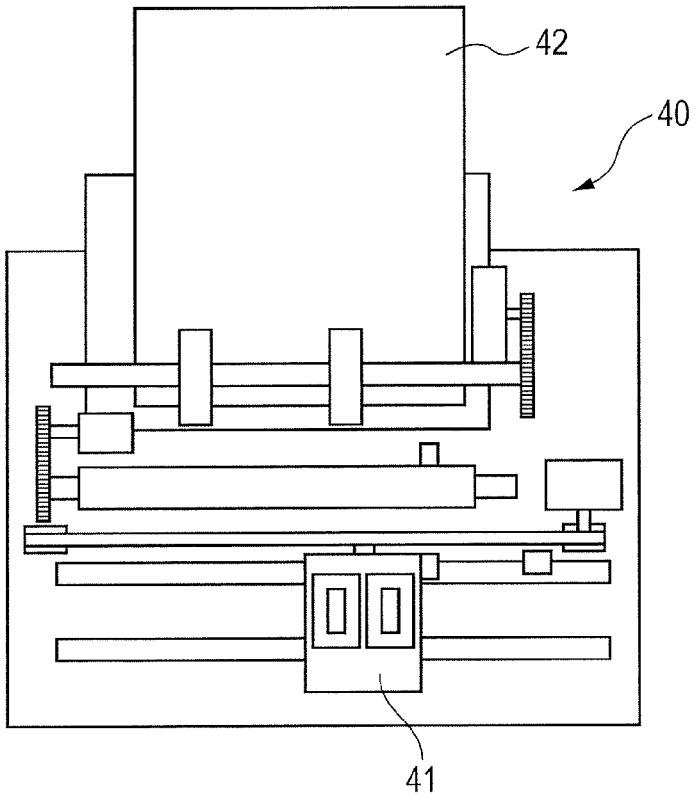
FIG. 3B is a plan view of such an ink jet recording device.

Referring now to FIGS. 3A and 3B, the following describes specific examples of an ink jet recording head equipped with a substrate for liquid ejection head according to the present invention, and such an ink jet recording device.

Firstly, FIG. 3A is a perspective view showing an exemplary ink jet recording head, on which a substrate for liquid ejection head according to the present invention (a substrate for ink jet recording head) can be mounted. In this ink jet recording head 30, the substrate for ink jet recording head 20 is electrically connected to the outside via a TAB (Tape Automated Bonding), and is mounted on an ink tank container (tank member) 21 to supply ink.

This ink jet recording head 30 is mounted at a carriage part 41 of an ink jet recording device 40 shown in FIG. 3B for use, for example. At this time, the ink jet recording head is disposed so that the face (ejection port face) formed with the ink ejection port of the substrate for ink jet recording head faces a recording face of a recording medium 42 such as paper during recording. In this ink jet recording head, ink is charged into the ink channel from the rear face of the substrate for ink jet recording head via an ink supply port. Then, pressure or heat is applied to the charged ink by the ejection energy generating element including a heat generating resistant element or the like, whereby ink is ejected from the ink ejection port and is made to adhere to a recording medium such as paper for recording.

<Manufacturing Method of Substrate for Liquid Ejection Head>

A manufacturing method of a substrate for liquid ejection head according to the present invention includes the following steps.

(1) forming, on a substrate including an ejection energy generating element, a metal mold member made of metal and having a flat surface, the metal mold member making up at least a part of a mold for a liquid channel, and a planarization layer made of the metal and having a flat surface, the planarization layer being configured to planarize the surface of a nozzle layer (2) coating the mold for a liquid channel and the planarization layer with negative-type photosensitive resin, thus forming a negative-type photosensitive resin layer to be the nozzle layer (3) exposing the negative-type photosensitive resin layer with ultraviolet rays, thus forming an ejection port (4) selectively removing the mold for liquid channel, thus forming a liquid channel.

The above step (1) may include the following steps (1-1) and (1-2), and may consist of these steps (first embodiment): (1-1) forming a metal layer made of the metal and having a flat surface on the substrate including the ejection energy generating element; and (1-2) performing patterning of the metal layer to form the metal mold member and the planarization layer.

In the step (1-1), the metal layer may be formed on the substrate including the ejection energy generating element by forming a metal film made of the metal by sputtering and planarizing a surface of the metal film by chemical mechanical polishing.

In the step (1), the metal mold member and the planarization layer may be formed by forming, on the substrate including the ejection energy generating element, a first metal film to be the metal mold member and a second metal film to be the planarization layer by electrolytic plating and planarizing a surface of the first metal member and a surface of the second metal member by chemical mechanical polishing (second embodiment).

The manufacturing method further may include, between steps (1) and (2), (5) forming a positive-type photosensitive resin layer on the metal mold member, the positive-type photosensitive resin layer becoming a part of the mold for liquid channel. The manufacturing method further may include, between steps (3) and (4), (6) forming a liquid supply port at the substrate including the ejection energy generating element.

Referring to the drawings, the following is a detailed description on these steps by way of an example of a substrate for ink jet recording head. A large number of substrates for ink jet recording head typically are formed together in a grid pattern on a silicon substrate (corresponding to the substrate 1 in FIGS. 1A to 1K) of a few to ten or a few inches more in size (1 inch=25.4 mm). The thus formed substrates for head are cut and separated by dicing or the like to be a chip as shown in FIG. 2. The following describes this one chip.

(Step 1)

First Embodiment

Step 1-1

Firstly, as shown in FIGS. 1A and 1B, an ejection energy generating element 4 and a basic circuit therefor such as a driving circuit 2 are formed on a substrate 1, thus forming an ejection element substrate 20*a*. This ejection element substrate 20*a* specifically includes: the substrate 1; the ejection energy generating element 4; the driving circuit 2 to selectively drive the ejection energy generating element 4; a metal wiring layer 3 electrically connecting the ejection energy generating element 4 and the driving circuit 2, for example; and an insulation protection layer 5.

The driving circuit 2, the metal wiring layer 3 and the ejection energy generating element 4 are formed on the substrate 1 by methods such as vacuum film formation, photolithography and etching. Herein, the driving circuit 2, the metal wiring layer 3 and the ejection energy generating element 4 may be disposed on the surface of the substrate 1, or another member may be disposed between these elements and the substrate 1.

The substrate 1 may be a substrate made of silicon (silicon substrate), and specifically a monocrystalline silicon substrate of P-type and having crystal orientation of 100, for example.

The ejection energy generating element 4 used may be a well-known suitable element in the field of ink jet recording heads, for example. This ejection energy generating element 4 may be formed by providing a gap of an aluminum wiring layer 4*a* on a heat generating resistant layer (not illustrated) made of a tantalum-silicon-nitride film (TaSiN). In this case, current flows through TaSiN residing at the gap portion of the aluminum wiring layer, thus generating heat at the ejection energy generating element 4 and so thus heating ink disposed on the ejection energy generating element 4.

Herein, the driving circuit 2 may include, for example, an n-channel field-effect transistor (NMOS) or a p-channel field-effect transistor (PMOS). The metal wiring layer 3 may be made of, for example, gold, nickel, copper or aluminum alloy.

The insulation protection layer (protective film) 5 may be provided on the substrate 1 by chemical vapor deposition (CVD), for example, and more specifically on the substrate 1 as well as the surfaces of the ejection energy generating element 4 and other elements (e.g., the driving circuit 2 and the metal wiring layer 3) disposed on the substrate 1. This insulation protection layer can cover these surfaces uniformly. This insulation protection layer can easily prevent corrosion of the ejection energy generating element 4 by ink and can function as an interlayer dielectric film for a metal layer (e.g., a planarization layer 9*b*) described later, which is formed on the ejection element substrate. The insulation protection layer 5 may be, for example, a silicon nitride film, a silicon oxide film or a carbon added silicon nitride film. This insulation protection layer 5 may have any appropriate thickness (film thickness), for example, of 200 to 500 nm.

Figure 5A:
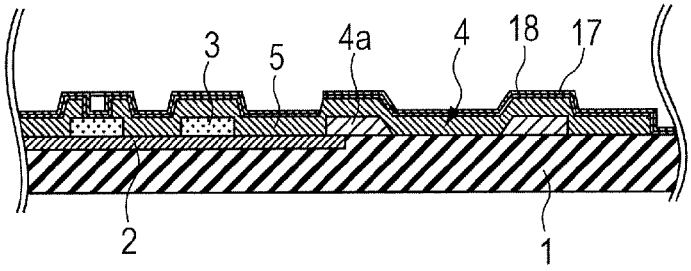
FIGS. 5A, 5B, 5C, 5D and 5E are schematic cross-sectional views to describe the steps of still another embodiment of the present invention.

On this insulation protection layer 5, other members such as the diffusion barrier layer 17 and the plating seed layer 18 shown in FIG. 5A may be laminated.

As shown in FIG. 1B, an opening 6 may be provided for electric connection between the metal wiring layer 3 and a metal layer to be formed later by patterning of the insulation protection layer 5. At the same time, an opening 7 for communication between the ink supply port and the ink channel as stated above may be formed by removing the insulation protection layer 5 at a corresponding position by patterning. This patterning of the insulation protection layer 5 may be performed as follows, for example. Firstly, positive-type photoresist of about a few μm in thickness (e.g., positive-type photoresist, produced by Tokyo Ohka Kogyo Co., Ltd. product name: THMR-iP5700) is applied on the insulation protection layer 5 by spin coating, and this resist is exposed to i-line, for example, via a desired photomask. Then, development is performed using alkaline developing solution such as tetramethylammonium hydroxide (TMAH), thus solving the exposed part of the positive-type photoresist for removal. Next, dry etching is performed for the insulation protection layer 5 in vacuum using fluorine gas such as $CHF_3$ or $SF_6$ while using this resist subjected to development as a mask, thus patterning the insulation protection layer 5. Then, the photoresist used as the mask is removed by asking or resist remover (e.g., photoresist remover produced by Tokyo Ohka Kogyo Co., Ltd. product name: remover 106). In this way, the ejection element substrate 20*a* provided with the insulation protection layer including the openings 6 and 7 can be formed as shown in FIG. 1B.

Next, as shown in FIG. 1C, a metal film is formed on the ejection element substrate 20*a*, more specifically, on the entire surface of the ejection element substrate 20*a* (in FIG. 1C, the surface of the insulation protection layer), thus forming a thick metal film 8.

Metal for this metal film 8 and a metal layer 9 described later, which is formed by planarizing the surface of this metal film includes, for example, aluminum, copper, nickel, gold, titanium, tungsten, palladium, iron, and chrome. These metals may be used alone or a plurality of metals may be used as combination (e.g., in the form of an alloy made of a plurality of metals).

The present invention preferably uses, as this metal, any one metal or an alloy containing two or more metals selected from a group consisting of aluminum, copper, nickel, gold, titanium and tungsten from the viewpoint of material cost and mass productivity.

The thickness of the metal film 8 may be set appropriately for a substrate for ink jet recording head to be manufactured. From the viewpoint of completely embed a difference in thickness due to the underlayer and form a flat surface by planarization, the thickness is preferably 3 μm or more, and from the viewpoint of removability after the film is used as the mold for nozzle, the thickness is preferably 50 μm or less. Further, from the viewpoint of margin considering film loss due to subsequent planarization process, the thickness is preferably 5 μm or more, and from the viewpoint of productivity, the thickness is preferably 30 μm or less.

The metal film 8 is formed by sputtering using inert gas (e.g. argon gas) in vacuum atmosphere, electrolytic plating, or electroless plating such as reduction plating.

Subsequently, as shown in FIG. 1D, the surface of this metal film 8 (the entire face (surface) on the side where the nozzle layer is to be formed) is planarized, thus forming the metal layer 9 made of metal and having the flat surface (the entire surface) on the ejection element substrate 20*a*.

The surface of the metal film 8 may be planarized as follows, for example. That is, planarization may be performed by chemical mechanical polishing (CMP), mechanical polishing or electropolishing, for example.

The film thickness of the metal layer 9 can be measured by X-Ray Fluorescence analysis (XRF). Setting the thickness of the metal layer 9 at a part disposed above (above in the sheet) the ejection energy generating element 4 shown in FIG. 1A as a reference (100%), the degree of planarization (flatness) at the surface of the metal layer 9 is preferably within ±5% in the surface. A part of this metal layer 9 functions as at least a part of the ink channel mold member, and so the thickness thereof relates to the height of the ink channel and determines the amount of ejected liquid droplets. The degree of planarization within ±5% easily can suppress a variation of the amount of liquid droplets ejected from the liquid ejection element and can easily avoid adverse effects on the head performance.

This metal layer 9 is subjected to patterning at Step 1-2, and a region of the metal layer 9 to be the ink channel (a part to be the metal mold member described later) is used as at least a part of the mold for the ink channel as stated above. In this metal layer 9, a region disposed above (above in the sheet of FIG. 1D) the driving circuit or the like (a part to be the planarization layer described later) plays a role of planarizing the surface of the nozzle layer of the substrate for ink jet recording head to be manufactured. As a result, the thickness of the nozzle layer, especially the thickness of the nozzle layer at a part of the nozzle (ejection port and ink channel) part can be made uniform. The region to be the planarization layer is available as electricity wiring as well. That is, the planarization layer can make up at least a part of electricity wiring.

Step 1-2

Next, as shown in FIG. 1E, the metal layer having a planarized surface (planarized metal layer) 9 is subjected to patterning, thus forming a metal mold member 9*a* and a planarization layer 9*b* on the ejection element substrate 20*a*. Both of these metal mold member 9*a* and planarization layer 9*b* are made of the metal making up the metal layer 9 and have flat surfaces (entire surface).

The metal mold member 9*a* and the planarization layer 9*b* preferably have the flatness that is in the same range as that of the metal layer 9. That is, at Step 1-2, the metal mold member 9*a* and the planarization layer 9*b* are manufactured preferably using a patterning method capable of directly utilizing the flatness of the surface of the metal layer 9 for the metal mold member 9*a* and the planarization layer 9*b*.

Specifically the following patterning method can be used, for example. Firstly, a photosensitive positive-type photoresist is applied on the metal layer 9, specifically on the entire surface of the metal layer 9, which is then exposed to i-line, for example, via a mask pattern and is subjected to development using alkaline developing solution, thus producing a resist pattern. Subsequently using this resist pattern as a mask, the metal layer 9 is dry-etched in vacuum using chorine-based gas (e.g., $BCl_3$ or $Cl_2$). Then, the used resist mask is removed by asking and resist remover (e.g., photoresist remover produced by Tokyo Ohka Kogyo Co., Ltd. product name: remover 106).

In the present invention, a metal layer part on the ejection energy generating element 4, i.e., the metal mold member 9*a* makes up at least a part of the ink channel mold as stated above. This metal mold member 9*a* does not absorb ultraviolet rays during ultraviolet ray exposure, but causes reflection of the ultraviolet rays at the flat surface without a difference in thickness. This metal mold member 9*a* can suppress influences of the reflection due to a difference in thickness of the underlayer provided below the nozzle layer (on the substrate 1 side) during the formation of the ejection port by ultraviolet rays exposure, and so deformation of the ejection port can be prevented.

The ink channel mold member made of metal (metal mold member) is excellent in the following points as compared with the anti-reflection film made of SiN or the like described in Japanese Patent Application Laid-Open No. 2009-178906, which is provided on the ejection element substrate to suppress the influences by reflection light. That is, since a material making up the insulation protective layer does not have to have an anti-reflection function, materials of the film can be selected more freely.

In the case of the ink channel mold member made of an organic material (e.g., positive-type photosensitive resin) applied by spin coating, the unevenness of the underlayer greatly affects the distribution of the film thickness applied on the substrate for ink jet recording head and on the silicon substrate face. On the other hand, the metal mold member of the present invention is formed thick, and then planarization processing is performed for polishing from the surface, and so influences of the unevenness of the underlayer on the film thickness of the mold member can be easily suppressed. Herein some polishing conditions enable mechanical polishing of the surface of the ink channel mold member made of an organic material as well. However, the metal mold member is more excellent than the mold member made of an organic material in terms of the improved etching selectivity between the mold member and the nozzle layer made of negative-type photosensitive resin during removal of the ink channel mold member and reduced damage of the nozzle layer.

A part of the metal layer that is formed at a region other than the region to be the ink channel mold and is disposed between the nozzle layer and the ejection element substrate, i.e., the planarization layer 9*b* embeds the unevenness of the surface of the ejection element substrate for planarization. This means that the film (e.g., a negative-type photosensitive resin layer to be the nozzle layer) to be applied by spin coating on this planarization layer also can have a flat surface, and as a result the thickness of these films can be made uniform.

Herein, a part of the metal layer formed at a region other than the region as the ink channel mold member (e.g., the planarization layer 9*b*) functions not only to planarize the unevenness of the surface of the ejection element substrate but also as electricity wiring.

Patterning of the metal layer 9 may involve not only the formation of the metal mold member 9*a* and the planarization layer 9*b* but also the electrode pad 16 made of metal making up the metal layer 9 as shown in FIG. 2 at the same time. The electrode pad 16 also has a flat surface.

Second Embodiment

The metal film may be formed by electrolytic plating or electroless plating such as reduction plating, and in that case, a metal mold member and a planarization layer may be formed as follows, for example.

Firstly, as shown in FIG. 5A, the entire surface of the ejection element substrate 20*a* shown in FIG. 1B is coated with a diffusion barrier layer 17 and a plating seed layer 18 by sputtering using inert gas in vacuum, for example.

The diffusion barrier layer plays a role of preventing the degradation of reliability of electrical connections because an electricity wiring layer and an electrode pad layer are diffused at the heat-treatment process to form an alloy thereof. This diffusion barrier layer may be made of titanium tungsten alloy or titanium, for example. The diffusion barrier layer may have a thickness of 100 nm to 300 nm, for example.

The plating seed layer functions as an electrode for electrolytic plating and an adhesion layer with the diffusion barrier layer. The plating seed layer may be made of gold, for example. The plating seed layer may have a thickness of 50 nm to 200 nm, for example.

Figure 5B:
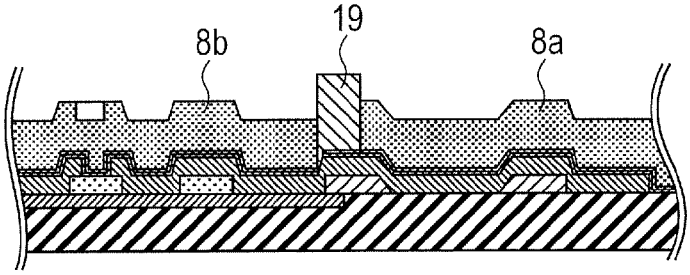

Next, on the surface of this plating seed layer 18, photosensitive resin is applied to form a resist mask 19 for electrolytic plating, and this resin is exposed to ultraviolet rays through a mask not illustrated, which is then subjected to development using alkaline developing solution, for example, thus forming the resist mask 19 for electrolytic plating. This resist mask 19 may have a pattern corresponding to a metal mold member 9*a* and a planarization layer 9*b* (as well as electrode pads, if needed) to be manufactured. For instance, in the case of using, as this photosensitive resin, positive-type photosensitive resin (e.g., positive-type photoresist, produced by Tokyo Ohka Kogyo Co., Ltd. product name: PMER), the resist mask 19 manufactured may have openings at parts corresponding to the metal mold member, the planarization layer and the electrode pad, if needed. As shown in FIG. 5B, the resist mask 19 may have any appropriate thickness that is larger than the thickness of a metal film (e.g., a first metal film 8*a* and a second metal film 8*b*) to be manufactured.

Subsequently, the substrate provided with this resist mask is subjected to electrolytic plating in bath liquid suitable for the metal film to be manufactured, thus forming the first metal film 8*a* as the metal mold member and the second metal film 8*b* as the planarization layer. Herein, in the configuration of the substrate for liquid ejection head including electrode pads made of the same metal as well, a third metal film as these electrode pads also may be formed. This bath liquid may be ethylmethylimidazolium chloride-aluminum chloride bath, copper sulfate bath, nickel sulfamate bath, acid gold bath and the like. The first metal film and the second metal film may be made of the same material and may have the same thicknesses as those in first embodiment.

Figure 5C:
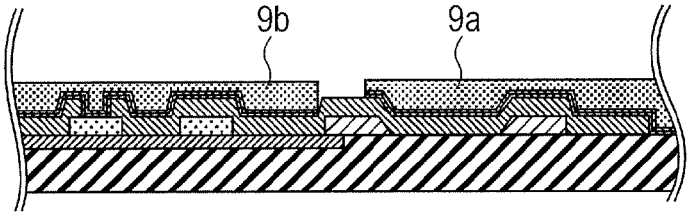

As shown in FIG. 5C, the resist mask 19 and the diffusion barrier layer 17 and the plating seed layer 18 at parts not coated with the metal film may be removed using a resist remover suitable for the raw materials (e.g., photoresist remover produced by Tokyo Ohka Kogyo Co., Ltd. product name: remover 106) or etching solution (e.g., hydrogen peroxide or iodine-potassium iodide), for example, after planarization of the surface of the metal film. As a method for planarizing these metal films, Chemical Mechanical Polishing (CMP), mechanical polishing, electropolishing or the like may be used similarly to first embodiment. The metal mold member and the planarization layer manufactured desirably have surfaces with the degree of planarization (flatness) within +5% in the surface similarly to first embodiment.

In this way, Step 1 of the present invention may be implemented by various embodiments as shown in FIGS. 1A to 1E and FIGS. 5A to 5C as long as it finally forms the metal mold member 9*a* and the planarization layer 9*b* on the ejection element substrate 20*a*.

Figure 4A:
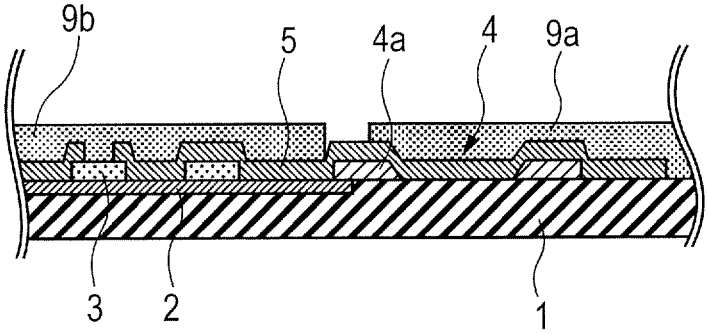
FIGS. 4A, 4B and 4C are schematic cross-sectional views to describe the steps of another embodiment of the present invention.
Figure 4B:
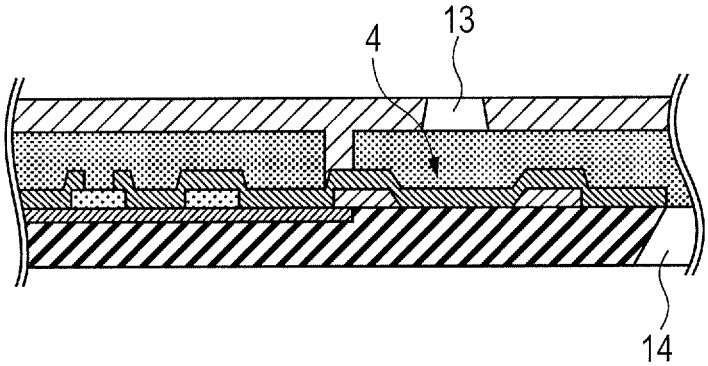
Figure 5D:
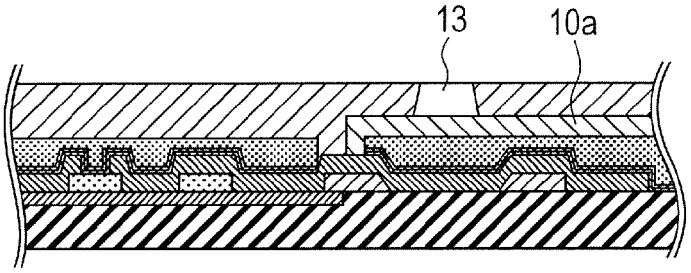
Figure 5E:
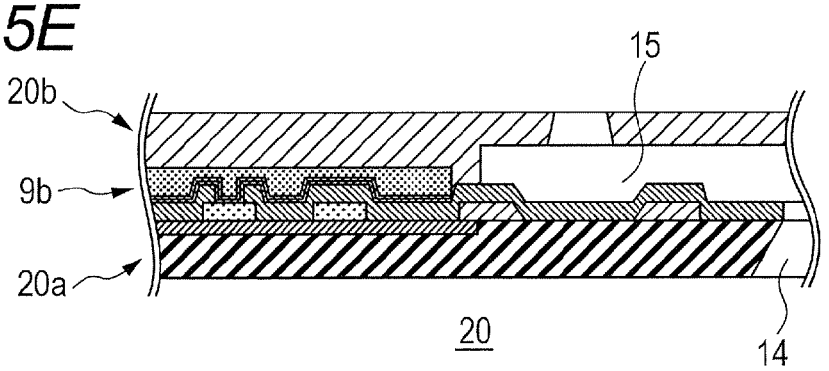

The mold for ink channel may be made up of the metal mold member 9*a* only as in FIGS. 4A and 4B or may be made up of a plurality of members, i.e., the metal mold member 9*a* and another member (e.g., a positive-type photosensitive resin layer 10*a* manufactured at Step 5) as in FIGS. 1G to 1J and FIG. 5D. The ink channel mold made up of such a plurality of members enables different heights (vertical thickness in the sheet) between the planarization layer 9*b* and the ink channel 15 as shown in FIG. 1K and FIG. 5E. On the other hand, in the configuration of the ink channel mold made up of the metal mold member only, although the planarization layer 9*b* and the ink channel in the substrate head obtained will have the same thickness, the number of manufacturing steps, specifically, the steps of manufacturing the other member and removing the same, can be reduced.

For instance, the following Step 5 may be performed between Step 1 and Step 2, whereby the ink channel mold may be made up of a plurality of members.

Step 5

Firstly, as shown in FIG. 1F, on the surface of the ejection element substrate on which the metal mold member 9*a* (first ink channel mold member) and the planarization layer 9*b* are disposed, positive-type photosensitive resin is applied by spin coating, for example, thus forming a resin film 10 to form a second ink channel mold member. At this time, since the underlayer (in FIG. 1F, the metal mold member 9*a* and the planarization layer 9*b*) coated with the resin film 10 has a substantially flat surface due to the processing of Step 1, the resin film 10 formed on the surface of the substrate may have more uniform thickness than the conventional cases without such a metal layer with a flat surface, i.e., the cases of the underlayer with an uneven surface.

This positive-type photosensitive resin may be polymethyl isopropenyl ketone, produced by Tokyo Ohka Kogyo Co., Ltd. product name: ODUR-1010, for example.

Next, as shown in FIG. 1G, this resin film 10 is exposed to ultraviolet rays via a mask pattern (not illustrated), for example, which is then subjected to development using organic solvent such as methyl isobutyl ketone or propyleneglycol monomethylether acetate, thus forming a positive-type photosensitive resin layer (second ink channel mold member) 10*a* to be a part of a mold 11 for ink channel on the metal mold member 9*a*. In this way the ink channel mold 11 (liquid channel mold) made up of the metal mold member 9*a* as the first ink channel mold member and the positive-type photosensitive resin layer 10*a* as the second in channel mold member may be formed.

The metal mold member 9*a* and the positive-type photosensitive resin layer 10*a* may have appropriate shapes suitable for the shape of the ink channel to be manufactured. Although FIG. 1G shows an example where the positive-type photosensitive resin layer 10*a* covers the metal mold member 9*a*, the positive-type photosensitive resin layer and the metal mold layer may be appropriately arranged suitably for the shape of the ink channel mold.

Step 2

Next, as shown in FIG. 1H, negative-type photosensitive resin is applied by spin coating, for example, so as to coat the ink channel mold 11 and the planarization layer 9*b*, thus forming a negative-type photosensitive resin layer 12 to be the above-described nozzle layer. This negative-type photosensitive resin may be mixture of epoxy resin, silane coupling agent and photo-acid-generating agent including xylene as application solvent.

Step 3

Next, as shown in FIG. 1I, the negative-type photosensitive resin layer 12 is exposed to ultraviolet rays via a mask pattern (not illustrated), which is then subjected to development using organic solvent such as xylene, thus forming an ink ejection port 13 to eject ink. For ultraviolet rays for exposure, i-line (wavelength: 365 nm) may be used as the exposure source, for example, and the device for exposure may be a stepper, for example. In FIG. 1I, the ink ejection port 13 is formed above (above in the sheet) the ejection energy generating element 4.

Step 6

Next, as shown in FIG. 1J, an ink supply port 14 is formed from the rear face (face where the nozzle layer is not formed) of the substrate obtained by Step 3 by silicon anisotropic etching, for example, so as to communicate with the ink channel. This ink supply port may be manufactured by the following method, for example. Firstly, patterning of the ejection element substrate (more specifically, a silicon substrate 1) is performed at the rear face thereof using a mask, and this substrate is immersed in strong alkaline solution such as heated tetramethylammonium hydroxide (TMAH) aqueous solution, whereby the ink supply port 14 can be formed. At this time, in order to protect other parts (especially a part to be the nozzle layer) from the strong alkaline solution, a protective film (not illustrated) may be formed at the surface (ejection port face (nozzle face)) of the substrate by spin coating, for example, the protective layer being selectively removable and having alkali-resistance. This protective layer may be made of cyclized rubber having alkali-resistance (specifically, product name: OBC produced by Tokyo Ohka Kogyo Co., Ltd.).

Step 4

Next, as shown in FIG. 1K, the ink channel mold (in FIGS. 4B and 4C, the metal mold member only and FIGS. 1J and 1K and FIGS. 5D and 5E, the metal mold member and the positive-type photosensitive resin layer) is selectively removed, whereby an ink channel 15 is formed so as to communicate with the ink supply port 14 and the ink ejection port 13 and hold ink on the ejection energy generating element 4. At this time, the positive-type photosensitive resin layer 10*a* may be removed selectively using resist remover mainly containing organic solvent. The metal mold member 9*a* may be removed selectively using wet etching solution suitable for the metal making up the mold member. For instance, for aluminum used for the metal, mixed acid containing phosphoric acid, nitric acid and acetic acid may be used as the wet etching solution.

In this way, the substrate for ink jet recording head 20 including the ejection element substrate 20*a* and the nozzle layer (nozzle plate) 20*b* having the ink ejection port 13 and the ink channel 15 can be obtained.

EXAMPLES

The following describes the present invention in more detail by way of examples. Although a large number of substrates for ink jet recording head are typically formed together on one silicone substrate, followed by cutting and separating by dicing or the like for one chip as stated above, the following examples describe one chip.

Example 1

Example 1 formed the ink channel mold with two layers including two types of materials of a metal mold member and a positive-type photosensitive resin layer, and used, as electricity wiring, a part of a metal layer 9 (planarization layer) having a planarized surface. Referring to FIGS. 1A to 1K, the following describes Example 1 in detail.

Firstly, on the surface (the face on which a nozzle layer is to be formed) of a monocrystalline silicon substrate 1 of P-type and having crystal orientation of 100, an ejection energy generating element 4, a driving circuit 2 including a n-channel field-effect transistor (NMOS) and a metal wiring layer 3 made of aluminum-copper alloy to connect the ejection energy generating element and the driving circuit were formed by vacuum film formation, photolithography and etching. The ejection energy generating element 4 was formed by providing a gap of an aluminum wiring layer 4*a* on a heat generating resistant layer (not illustrated) made of a tantalum-silicon-nitride film (TaSiN). This ejection energy generating element 4 generates heat by current flowing through TaSiN residing at the gap of the aluminum wiring layer.

Subsequently, on the entire face of this substrate, an insulation protection layer 5 made of a silicon nitride film was formed to have a film thickness of 300 nm by CVD using silane, ammonia and nitrogen (FIG. 1A).

Next, on the surface of this insulation protection layer 5, a positive-type photoresist (not illustrated) made of novolac resin or the like was applied by spin coating to have a film thickness of 3 μm. Then, this positive-type photoresist was exposed to i-line using a corresponding photomask (not illustrated), which was then subjected to development using alkaline developing solution (TMAH aqueous solution, product name: NMD-3) to dissolve and remove the exposed parts of the photoresist. Next, using this photoresist as a mask, dry etching was performed in vacuum using fluorine gas (trifluoromethane), thus performing patterning of the insulation protection layer 5. As a result, on the insulation protection layer 5, an opening 6 to electrically connect the metal wiring layer 3 and a metal layer to be manufactured later (specifically, a planarization layer) and an opening 7 to be a part of an ink supply port were formed. Then, the photoresist used as the mask was removed by photoresist remover produced by Tokyo Ohka Kogyo Co., Ltd. product name: remover 106.

Thus, the ejection element substrate 20*a* was obtained (FIG. 1B).

Next, on the entire surface of this ejection element substrate 20*a*, a metal film 8 made of aluminum was formed by sputtering in vacuum environment using argon gas to have a film thickness of 10 μm (FIG. 1C).

Subsequently, the surface of this metal film 8 was planarized by chemical mechanical polishing (CMP), thus forming a metal layer 9 made of aluminum and having a planarized surface on the ejection element substrate (FIG. 1D, Step 1-1). The metal layer 9 had the flatness that was +5% in the surface of the metal layer 9, and had a thickness (average value) of 5 μm.

Next, on the surface of the metal layer 9 made of aluminum, a photosensitive positive-type resist made of novolac resin was applied, and this positive-type resist was exposed to i-line via a mask pattern (not illustrated), which was then subjected to development using alkaline developing solution, thus manufacturing a resist pattern. Then, using this resist pattern as a mask, the metal layer 9 was dry-etched (patterning) in vacuum using chlorine gas. The resist mask used was then removed by photoresist remover produced by Tokyo Ohka Kogyo Co., Ltd. product name: remover 106. In this way, the metal mold member 9*a* made of aluminum, becoming as a part (first ink channel mold member) of the ink channel mold and having a flat surface and the planarization layer 9*b* made of aluminum and having a flat surface so as to planarize the surface of the nozzle layer were formed on the ejection element substrate 20*a* (FIG. 1E, Step 1-2). These metal mold member 9*a* and planarization layer 9*b* had the flatness that was within ±5% in the surface.

Next, on the entire surface of the ejection element substrate on which the metal mold member and the planarization layer were disposed, positive-type photosensitive resin made of polymethyl isopropenyl ketone, produced by Tokyo Ohka Kogyo Co., Ltd. product name: ODUR-1010 was applied by spin coating, thus forming a resin film 10 (FIG. 1F). Subsequently, this resin film 10 was exposed to ultraviolet rays via a mask pattern not illustrated, which was then subjected to development using organic developing solution including mixture solvent of 50 mass % of methyl isobutyl ketone (MIBK) and 50 mass % of propylene glycol monomethyl-ether acetate (PGMEA), whereby a positive-type photosensitive resin layer 10*a* making up a part (second ink channel mold member) of the ink channel mold was formed on the substrate (FIG. 1G, Step 5). In this way, the ink channel mold 11 including the metal mold member 9*a* and the positive-type photosensitive resin layer 10*a* were formed on the ejection element substrate.

Next, on the entire surface of the ejection element substrate provided with the ink channel mold and the planarization layer, negative-type photosensitive resin including the mixture of 50 mass % of epoxy resin as a base material, 3 mass % of silane coupling agent as an adhesive auxiliary agent and 2 mass % of photo-acid-generating agent as polymerization initiator and including 45 mass % of xylene as application solvent was applied by spin coating, thus forming a negative-type photosensitive resin layer 12 covering this ink channel mold and the planarization layer (FIG. 1H, Step 2). This negative-type photosensitive resin layer 12 finally functions as a nozzle layer playing a role of an ink channel wall and an ink ejection port (orifice) wall.

Next, using i-line as the exposure source and a stepper as the device for exposure, this negative-type photosensitive resin layer 12 was exposed to ultraviolet rays via a mask pattern (not illustrated), which was then subjected to development using xylene, thus forming an ink ejection port 13 (FIG. 1I, Step 3).

Next, the face (ejection port face) of the thus obtained substrate on which the ink ejection port was formed was covered with a protective member made of cyclized rubber having alkali-resistance (produced by Tokyo Ohka Kogyo Co., Ltd., product name: OBC) by spin-coating for protection. Subsequently, patterning of the rear face of this substrate was performed using a mask, which was then immersed in strong alkaline solution (tetramethylammonium hydroxide (TMAH) aqueous solution heated to 80° C.) for silicon anisotropic etching, thus forming the ink supply port 14 from the rear face of the substrate (FIG. 1J, Step 6).

Next, the positive-type photosensitive resin layer 10*a* was removed by resist remover including organic solvent, and the metal mold member 9*a* made of aluminum was then removed by mixed acid (wet etching solution) containing the mixture solution of phosphoric acid, nitric acid and acetic acid, thus forming the ink channel 15 (FIG. 1K, Step 4). In this way, an ink channel communicating from the ink supply port 14 to the ink ejection port 13 was formed.

Thus, the substrate for ink jet recording head 20 was formed. This ink jet recording head substrate is electrically connected to the outside via Tape Automated Bonding (TAB), which is then mounted at a tank member for ink supply, whereby an ink jet recording head as shown in FIG. 3A can be obtained as stated above. An ink jet recording device provided with this head also can be obtained as stated above.

Example 2

In Example 2, the ink channel mold was formed with a metal layer only. Since the order of steps is substantially the same as Example 1, the following describes mainly differences from Example 1.

Firstly, similarly to Example 1, as shown in FIG. 4A corresponding to FIG. 1E, the ejection element substrate on which a metal mold member 9*a* and a planarization layer 9*b* were provided was obtained (Steps 1-1 to 1-2).

Next, without forming the second ink channel mold member, a negative-type photosensitive resin layer was formed on the entire surface of this ejection element substrate similarly to Example 1, the negative-type photosensitive resin layer including mixture of epoxy resin, silane coupling agent and photo-acid-generating agent as well as xylene as application solvent. Then an ink ejection port 13 was formed, and an ink supply port 14 was then formed from the rear face of the substrate (FIG. 4B, Steps 2 to 3, Step 6).

Figure 4C:
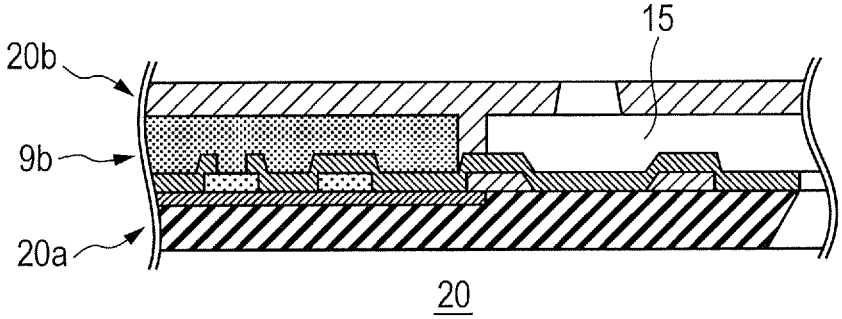

Next, the metal mold member 9*a* made of aluminum was removed by mixed acid (wet etching solution) containing the mixture solution of phosphoric acid, nitric acid and acetic acid, thus forming an ink channel 15 (FIG. 4C, Step 4). In this way, an ink channel communicating from the ink supply port 14 to the ink ejection port 13 was formed, and the substrate for ink jet recording head 20 was obtained.

Note here that, since the ink channel mold member of Example 2 is formed with only one layer of the planarized metal layer, the step of forming and removing the second ink channel mold member in Example 1 can be omitted. Similarly to Example 1, an ink jet recording head and an ink jet recording device provided with this substrate for ink jet recording head can be obtained.

Example 3

Unlike Example 1 and Example 2 forming a metal layer made of aluminum by sputtering using argon gas, Example 3 formed a metal film made of gold (Au) by electrolytic plating. Further unlike Example 1 and Example 2, Example 3 formed not only a metal mold member and a planarization layer but also electrode pads with this metal film, and used the planarization layer as electricity wiring. The following describes this example in detail.

Firstly, similarly to Example 1, the ejection element substrate 20*a* shown in FIG. 1B was manufactured. Next, on the entire surface of this ejection element substrate, a diffusion barrier layer 17 made of titanium tungsten alloy and a plating seed layer 18 made of gold for electrolytic plating were formed by sputtering in vacuum using argon gas (FIG. 5B). The diffusion barrier layer 17 had a film thickness of 200 nm, and the plating seed layer had a film thickness of 100 nm.

Next, on the surface of the thus formed plating seed layer 18 on the ejection element substrate, a photosensitive positive-type resist made of novolac resin was applied, which was then exposed to ultraviolet rays via a mask (not illustrated) and was subjected to development using alkaline developing solution (TMAH aqueous solution), thus forming a resist mask 19 having a thickness of 8 μm for electrolytic plating. This mask 19 had openings at parts corresponding to the metal mold member, the planarization layer and the electrode pads.

Next, this substrate having resist mask was subjected to electrolytic plating in bath liquid including gold sulphite as a base material, whereby a plating gold layer (first to third metal films) with a thickness of 5 μm was formed at openings of the resist mask 19 (FIG. 5B).

Next, for planarization of the surface of this plating gold layer, Chemical Mechanical Polishing (CMP) was performed from the surface of the substrate on which the resist for plating and the gold plating layer were formed. Then the metal mold member 9*a* formed had a thickness of 3 μm on the ejection energy generating element. The thicknesses of the planarization layer 9*b* and the electrode pads formed can be calculated by considering differences in height of the underlayer together with the thickness of the metal mold member 9*a*. Then, the resist mask 19 was removed by a resist remover (photoresist remover produced by Tokyo Ohka Kogyo Co., Ltd. product name: remover 106), and the plating seed layer and the diffusion barrier layer 17, on which gold plating was not formed, were removed by iodine-based gold etching solution and hydrogen peroxide, respectively (FIG. 5C, Step 1). At this time, the plating gold layer may be slightly etched by the gold etching solution, which did not influence on the shape or film thicknesses and so posed no problems.

Next, similarly to Example 1, a positive-type photosensitive resin layer (second ink channel mold member) 10*a* made of novolac resin was formed, a negative-type photosensitive resin layer made of epoxy resin was formed, and then an ink ejection port 13 was formed. (FIG. 5D, Step 5, Steps 2 to 3). Then, similarly to Example 1, an ink supply port 14 was formed from the rear surface of the substrate (Step 6). Then, the metal mold member 9*a* made of gold was removed using iodine-based gold etching solution, and the positive-type photosensitive resin layer 10*a* was removed by hydrogen peroxide, thus forming an ink channel 15 (Step 5E, Step 4).

Thus, an ink channel communicating from the ink supply port 14 to the ink ejection port 13 was formed, and a substrate for ink jet recording head 20 was obtained.

Similarly to Example 1, an ink jet recording head and an ink jet recording device provided with this substrate for ink jet recording head can be obtained.

According to the present invention, a manufacturing method for a substrate for liquid ejection head can be provided, whereby the thickness of a nozzle layer (especially at an ejection port) can be made uniform thickness and the shape of the ejection port can be formed precisely.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-154598, filed on Jul. 10, 2012, which is hereby incorporated by reference herein in its entirety.

What is claimed is:

1. A method for manufacturing a substrate for a liquid ejection head including an ejection energy generating element to generate energy to eject liquid, and a nozzle layer including an ejection port to eject liquid and a liquid channel communicating with the ejection port, the liquid channel being configured to dispose liquid on the ejection energy generating element, the method comprising the steps of:

(1) forming, on the substrate including the ejection energy generating element, a metal mold member made of metal and having a flat surface, the metal mold member making up at least a part of a mold for the liquid channel, and a planarization layer made of the metal and having a flat surface;

(2) coating the mold for the liquid channel and the planarization layer with negative-type photosensitive resin, thus forming a negative-type photosensitive resin layer to be the nozzle layer;

(3) exposing the negative-type photosensitive resin layer to ultraviolet rays, thus forming the ejection port; and (4) selectively removing the mold for the liquid channel, thus forming the liquid channel, wherein the mold for liquid channel comprises a plurality of members, and wherein the method includes, between the step (1) and the step (2):

(5) forming a positive-type photosensitive resin layer on the metal mold member to be a part of the liquid channel.

2. The method according to claim 1, wherein the step (1) includes:

(1-1) forming a metal layer made of the metal and having a flat surface on the substrate including the ejection energy generating element; and (1-2) performing patterning of the metal layer, thus forming the metal mold member and the planarization layer.

3. The method according to claim 2, wherein in the step (1-1), the metal layer is formed on the substrate including the ejection energy generating element by forming a metal film made of the metal by sputtering and planarizing a surface of the metal film by chemical mechanical polishing.

4. The method according to claim 1, wherein in the step (1), the metal mold member and the planarization layer are formed by forming, on the substrate including the ejection energy generating element, a first metal film to be the metal mold member and a second metal film to be the planarization layer by electrolytic plating and planarizing a surface of the first metal member and a surface of the second metal member by chemical mechanical polishing.

5. The method according to claim 1, wherein the metal comprises any one metal, or an alloy including two or more metals, selected from the group consisting of aluminum, copper, nickel, gold, titanium, and tungsten.

6. A method for manufacturing a substrate for a liquid ejection head including an ejection energy generating element to generate energy to eject liquid, and a nozzle layer including an ejection port to eject liquid and a liquid channel communicating with the ejection port, the liquid channel being configured to dispose liquid on the ejection energy generating element, the method comprising the steps of:

(1) forming, on the substrate including the ejection energy generating element, a metal mold member made of metal and having a flat surface, the metal mold member making up at least a part of a mold for the liquid channel, and a planarization layer made of the metal and having a flat surface;

(2) coating the mold for the liquid channel and the planarization layer with negative-type photosensitive resin, thus forming a negative-type photosensitive resin layer to be the nozzle layer;

(3) exposing the negative-type photosensitive resin layer to ultraviolet rays, thus forming the ejection port; and (4) selectively removing the mold for the liquid channel, thus forming the liquid channel, wherein in the step (1), an electrode pad made of the metal is formed together with the metal mold member and the planarization layer.

7. A method for manufacturing a substrate for a liquid ejection head including an ejection energy generating element to generate energy to eject liquid, and a nozzle layer including an ejection port to eject liquid and a liquid channel communicating with the ejection port, the liquid channel being configured to dispose liquid on the ejection energy generating element, the method comprising the steps of:

(1) forming, on the substrate including the ejection energy generating element, a metal mold member made of metal and having a flat surface, the metal mold member making up at least a part of a mold for the liquid channel, and a planarization layer made of the metal and having a flat surface;

(2) coating the mold for the liquid channel and the planarization layer with negative-type photosensitive resin, thus forming a negative-type photosensitive resin layer to be the nozzle layer;

(3) exposing the negative-type photosensitive resin layer to ultraviolet rays, thus forming the ejection port; and (4) selectively removing the mold for the liquid channel, thus forming the liquid channel, wherein the planarization layer made of the metal makes up at least a part of electricity wiring.

8. The method according to claim 6, wherein the step (1) includes:

(1-1) forming a metal layer made of the metal and having a flat surface on the substrate including the ejection energy generating element; and (1-2) performing patterning of the metal layer, thus forming the metal mold member and the planarization layer.

9. The method according to claim 8, wherein in the step (1-1), the metal layer is formed on the substrate including the ejection energy generating element by forming a metal film made of the metal by sputtering and planarizing a surface of the metal film by chemical mechanical polishing.

10. The method according to claim 6, wherein in the step (1), the metal mold member and the planarization layer are formed by forming, on the substrate including the ejection energy generating element, a first metal film to be the metal mold member and a second metal film to be the planarization layer by electrolytic plating and planarizing a surface of the first metal member and a surface of the second metal member by chemical mechanical polishing.

11. The method according to claim 6, wherein the metal comprises any one metal, or an alloy including two or more metals, selected from the group consisting of aluminum, copper, nickel, gold, titanium, and tungsten.

12. The method according to claim 7, wherein the step (1) includes:

(1-1) forming a metal layer made of the metal and having a flat surface on the substrate including the ejection energy generating element; and (1-2) performing patterning of the metal layer, thus forming the metal mold member and the planarization layer.

13. The method according to claim 12, wherein in the step (1-1), the metal layer is formed on the substrate including the ejection energy generating element by forming a metal film made of the metal by sputtering and planarizing a surface of the metal film by chemical mechanical polishing.

14. The method according to claim 7, wherein in the step (1), the metal mold member and the planarization layer are formed by forming, on the substrate including the ejection energy generating element, a first metal film to be the metal mold member and a second metal film to be the planarization layer by electrolytic plating and planarizing a surface of the first metal member and a surface of the second metal member by chemical mechanical polishing.

15. The method according to claim 7, wherein the metal comprises any one metal, or an alloy including two or more metals, selected from the group consisting of aluminum, copper, nickel, gold, titanium, and tungsten.

* * * * *